US007426283B2

(12) United States Patent
Kaiya et al.

(10) Patent No.: US 7,426,283 B2
(45) Date of Patent: Sep. 16, 2008

(54) SPEAKER DEVICE AND HEAT-DISSIPATING MEMBER

(75) Inventors: Teruaki Kaiya, Yamagata (JP); Seiya Sato, Yamagata (JP)

(73) Assignees: Pioneer Corporation, Tokyo (JP); Tohoku Pioneer Corporation, Tendo-shi (JP)

( * ) Notice: Subject to any disclaimer, the term of this patent is extended or adjusted under 35 U.S.C. 154(b) by 436 days.

(21) Appl. No.: 11/205,319

(22) Filed: Aug. 17, 2005

(65) Prior Publication Data

US 2006/0050921 A1 Mar. 9, 2006

(30) Foreign Application Priority Data

Aug. 19, 2004 (JP) ..... 2004/239059

(51) Int. Cl.
*H04R 1/00* (2006.01)
*H04R 9/06* (2006.01)
*H04R 11/02* (2006.01)

(52) U.S. Cl. ..... 381/397; 381/419

(58) Field of Classification Search ..... 381/395, 381/397, 164, 165, 412, 414, 415, 433; 361/688
See application file for complete search history.

(56) References Cited

U.S. PATENT DOCUMENTS 4,933,975 A * 6/1990 Button ..... 381/397
5,748,753 A * 5/1998 Carver ..... 381/96
6,111,969 A * 8/2000 Babb ..... 381/396
6,219,431 B1 * 4/2001 Proni ..... 381/397
6,601,645 B1 * 8/2003 Abdo ..... 165/185
6,639,993 B2 * 10/2003 Kemmerer et al. ..... 381/397
6,678,387 B2 * 1/2004 Kemmerer ..... 381/397
6,721,435 B2 * 4/2004 Babb et al. ..... 381/407
6,774,510 B1 * 8/2004 Moro et al. ..... 310/12
7,057,314 B2 * 6/2006 Moro ..... 310/12
7,120,270 B2 * 10/2006 Aronson et al. ..... 381/397
2002/0106101 A1 * 8/2002 White et al. ..... 381/400
2004/0086145 A1 * 5/2004 Stiles ..... 381/412

FOREIGN PATENT DOCUMENTS

EP 624049 A2 * 11/1994

(Continued)

OTHER PUBLICATIONS

Poornima, K.A; "Moving magnet loudspeaker system with electronic compensation", Jan. 10, 2000, IEEE Procedings online No. 20010348, pp. 211-216.*

(Continued)

*Primary Examiner*—Sinh Tran
*Assistant Examiner*—Ryan C Robinson
(74) *Attorney, Agent, or Firm*—Foley & Lardner LLP

(57) ABSTRACT

An outer-radial magnetic-flux applying unit of a speaker device includes an annular main unit and at least one piece of annular sub-unit stacked atop a free end of the main unit. A heat-dissipating member composed of a material having a good thermal conductivity encompasses the outer-radial magnetic-flux applying unit including the sub-unit and is thermally bonded with the outer-radial magnetic-flux applying unit.

16 Claims, 7 Drawing Sheets

FOREIGN PATENT DOCUMENTS

| | | | | |
|---|---|---|---|---|
| GB | 2122841 | A | * | 1/1984 |
| JP | 63-52386 | U | | 4/1988 |
| JP | 63-200995 | U | | 12/1988 |
| JP | 5-074094 | U | | 10/1993 |
| JP | 408237793 | A | * | 9/1996 |
| JP | 2003-219494 | A | | 7/2003 |

OTHER PUBLICATIONS

Poulsen, Soren; "Integrating switch mode audio power amplifiers and electro dynamic loudspeakers for a higher power efficiency", Jun. 2004, 2004 35th Annual IEEE Power Electronics Specialists Conference p. 725-730.*

* cited by examiner

SPEAKER DEVICE AND HEAT-DISSIPATING MEMBER

BACKGROUND OF THE INVENTION

1. Field of the Invention

The present invention relates to a speaker device that includes a magnetic-flux applying unit that applies magnetic flux on a voice coil that is supported in a magnetic gap in a vibratable manner, and a heat-dissipating member for the speaker device.

2. Description of the Related Art

In a so-called outer-magnet speaker device, a center pole extends upward from the center of the speaker device. Annular magnets are disposed around the center pole. A top plate is stacked atop the annular magnet, the top plate and the annular magnets together forming a magnetic circuit. A magnetic gap is formed between the top plate and the center pole. A voice coil, connected to a diaphragm, is supported to vibrate in an axial direction of the center pole in the magnetic gap. When a magnetic flux is applied on the voice coil via the top plate, the voice coil vibrates in response to the sound signal supplied to the voice coil. This vibration of the voice coil causes the diaphragm to vibrate and generate a sound.

Each of the top plate and the center pole has a magnetic-flux applying unit that applies magnetic flux on the voice coil. The top plate, which is disposed outer radially to the voice coil, has an outer-radial magnetic-flux applying unit. The center pole, which is disposed inner radially to the voice coil, has an inner-radial magnetic-flux applying unit.

In such an outer-magnet speaker device, it is essential that the magnetic gap in the vibration direction of the voice coil be at least longer than the vibration stroke. Consequently, it is essential that the surface of the top plate facing the vibration direction (center pole axis direction) be of a certain length. In other words, it is essential that the top plate be of a certain thickness in the axial direction.

Thus, in a conventional speaker, instead of a single top plate, a plurality of top plates of a predetermined thickness in axial direction are stacked one on top of another. The method of achieving the predetermined thickness of the top plate by stacking a plurality of thinner top plates (see Japanese Patent Laid-Open Publication No. 2003-219494) is less expensive than using a single top plate of the required thickness.

Incidentally, in the outer-magnet speaker device having a structure described above, a large amount of heat is generated when the voice coil vibrates in response to the sound signal supplied to it. The heat from the voice coil is conducted to the top plate causing it to become hot. Since the heat is detrimental to the performance and durability of the speaker device, ways have been sought to resolve the problem of heat generation. The problem is more acute, particularly, in a bass speaker device requiring a large supply of current to the voice coil and in an automobile speaker device whose location does not allow quick heat dissipation because of space constraints. The following solutions have been proposed as conventional solutions to the problem.

(1) A method of heat dissipation is proposed in which the heat from the voice coil is conducted to a yoke and therefrom to a frame, and the heat from the frame is dissipated to the exterior (see Published Utility Model Application No. S63-52386).

(2) Another method of heat dissipation is proposed in which a radiator-plate composed of a material with a good thermal conductivity is provided between the top plate and the frame and the heat from the top plate is dissipated to the exterior via the frame (see Published Utility Model Application No. S63-200995).

(3) Yet another method of heat dissipation is proposed where a magnetic circuit cover is provided with an opening for air flow, and the heat from the voice coil escapes to the exterior through this opening (see Published Utility Model Application NO. H5-74094).

However, in the method involving heat dissipation via the yoke and the frame, the heat dissipation efficiency is low as no heat-dissipating unit is provided for the top plate. Hence, the issue is not completely addressed. In the method involving heat dissipation by way of providing the radiator plate between the top plate and the frame, there is no escape of heat through the yoke because the yoke and the frame are not in contact with each other. Hence, again, the issue is not completely addressed. In the method involving heat dissipation from the opening in the magnetic circuit cover, the ability for heat dissipation is not adequate enough. Hence, in this case too, the issue is not completely addressed. Further, in the speaker device having the top plate consisting of a plurality of plates stacked one on top of another provided as a outer-radial magnetic-flux applying unit, the heat from the second plate from the outer surface and those further inward is not easily dissipated, again failing to fully address the issue.

SUMMARY OF THE INVENTION

It is an object of the present invention to at least solve the problems in the conventional technology.

A speaker device according to one aspect of the present invention includes a magnet that generates magnetic flux; an inner-radial magnetic-flux applying unit including an outer circumferential surface; an outer-radial magnetic-flux applying unit including an inner circumferential surface, a main unit having a first diameter, and at least one piece of annular sub-unit having a second diameter stacked on an end of the main unit on a side of an opening of the main unit; a voice coil that is supported in a vibrating manner in a magnetic gap that is formed between the outer circumferential surface and the inner circumferential surface by a magnetic circuit formed with the magnet, the inner-radial magnetic-flux applying unit, and the outer-radial magnetic-flux applying unit, to which the magnetic flux is applied via the inner-radial magnetic-flux applying unit and the outer-radial magnetic-flux applying unit; and a heat-dissipating member that is made of a material with a good thermal conductivity, encompasses the end portion including the sub-unit, and thermally bonded with the outer-radial magnetic-flux applying unit.

A heat-dissipating member for a speaker device, according to another aspect of the present invention, is made of a material with a good thermal conductivity and thermally bonded with an outer-radial magnetic-flux applying unit that applies magnetic flux on a voice coil that is supported in a vibratable manner in a magnetic gap. The heat-dissipating member includes an annular end-face contact portion that encompasses an edge of an end portion of the outer-radial magnetic-flux applying unit on a side of an opening of the outer-radial magnetic-flux applying unit; and a bent portion running all around in a middle in a radial direction. The bent portion is engaged with a step formed on the end portion of the outer-radial magnetic-flux applying unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
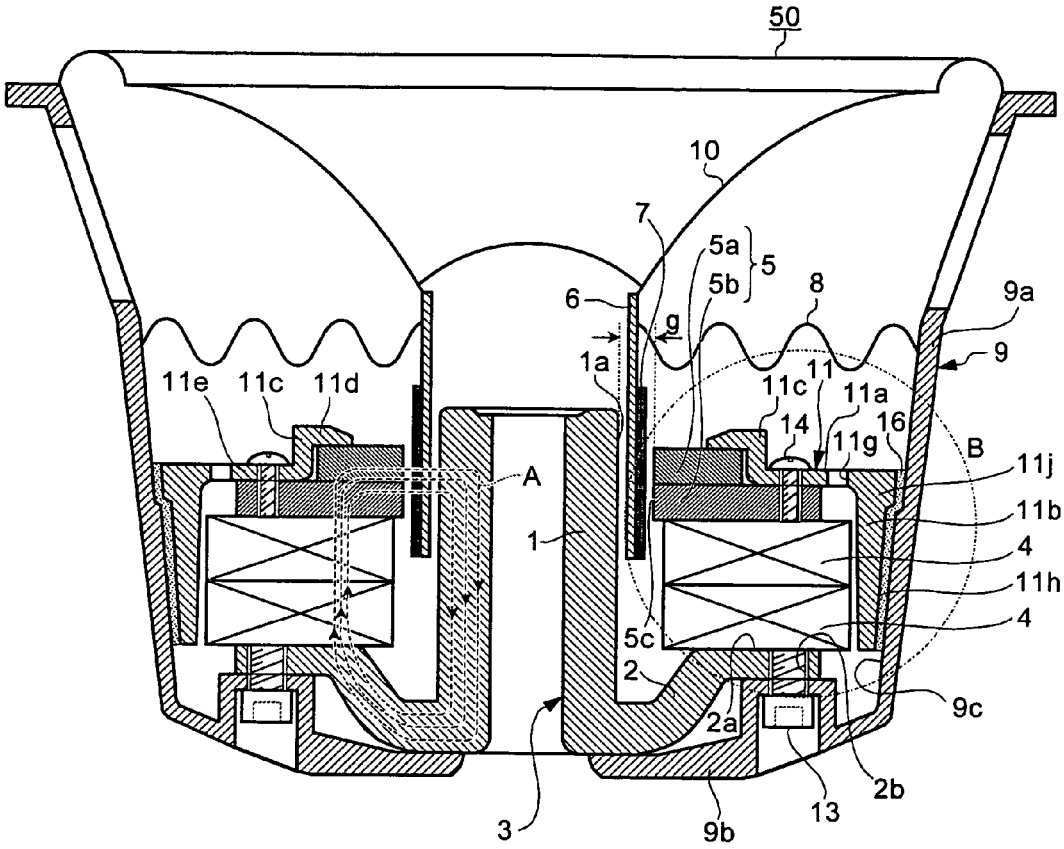
FIG. 1 is a vertical cross-section of a speaker device according to a first example of the present invention.

Exemplary embodiments of a speaker device and a heat-dissipating member according to the present invention are explained in detail with reference to the accompanying drawings. The present invention is not limited to the embodiments described here.

The speaker device according to a first embodiment of the present invention is a so-called outer-magnet speaker device. The speaker device has annular magnets that produce a magnetic flux. The speaker device further includes a center pole and a top plate that respectively form an inner-radial magnetic-flux applying unit and an outer-radial magnetic-flux applying unit arranged in an annular fashion. The annular magnets, the center pole, and the top plate together form a magnetic circuit. A magnetic gap is formed between the facing outer surface of the center pole and the inner surface of the top plate.

In other words, in the speaker device according to the first embodiment, the magnetic circuit consists of the cylindrical center pole, the annular magnets disposed around the center pole, and the top plate stacked atop the annular magnets, concentric with both the center pole and the annular magnets. The magnetic circuit forms the magnetic gap between the outer surface of the center pole and the inner surface of the top plate.

A voice coil is supported to vibrate in the axial direction of the center pole in the magnetic gap. One end of the voice coil is connected to a diaphragm. The center pole and the top plate apply magnetic flux on the voice coil. The voice coil then vibrates in response to the sound signal supplied to it and produces sound. To cut down the cost, in the speaker device according to the first embodiment, the top plate consists of an annular second plate, which is the main unit of the top plate, and at least one piece of an annular first plate, which is a subunit and is disposed atop the free end of the second plate. In other words, the top plate consists of two plates stacked one on top of the other in the axial direction of the center pole, one plate being a first plate, which is a subunit, disposed atop a free end, the other plate being a second plate, which is the main unit, and disposed between the first plate and the annular magnets.

In the speaker device constructed thus, heat is generated in the voice coil and spreads to the top plate next to it. To dissipate the heat, the speaker device according to the first embodiment has a heat-dissipating member that is thermally bonded with the free end of the top plate. The heat-dissipating member is composed of a material with a good thermal conductivity. The heat-dissipating member encompasses the free end of the top plate including the first plate.

The heat-dissipating member thermally bonds with at least the second plate and absorbs the heat from the second plate. A step is formed on the free end of the top plate because of the diameter of the first plate being smaller than that of the second plate. The heat-dissipating member has a curvature in the middle all around in the radial direction, conforming to the step contour. The heat-dissipating member includes an inner-radial member disposed on the inner-radial side of the curvature and in contact with the first plate, and an outer-radial member disposed on the outer-radial side of the curvature and in contact with the second plate. The outer-radial member is secured to the second plate by a bolt that serves as a fastening member that penetrates intersecting the contact surface. Air-flow orifices are provided in the heat-dissipating member to facilitate air circulation between the space within the heat-dissipating member and the space outside the heat-dissipating member.

The speaker device according to the first embodiment further includes a frame that encloses the magnetic circuit. The outer surface of the heat-dissipating member is thermally bonded with the frame. The outer surface of the heat-dissipating member, while thermally bonding with the frame, widens along the inner surface of the frame, forming a frame contact portion. Further, a step is provided on the inner surface of the frame into which the outer surface of the heat-dissipating member engages.

The speaker device thus constructed allows effective dissipation of heat from the top plate even if the top plate consists of plural stacked plates forming an outer-radial flux applying unit. Further, there is improved thermal bond between the first plate and the second plate, resulting in enhanced durability and reliability of the product.

The term "outer-radial magnetic-flux applying unit" refers to that member of the pair of members disposed facing each other and forming a magnetic gap between them and a magnetic circuit along with a magnet, that applies a magnetic flux on a voice coil set in the magnetic gap, which is disposed outer radially. In an outer-magnet speaker device such as the speaker device according to the first embodiment, the top plate forms the outer-radial magnetic-flux applying unit. In an inner-magnet speaker device described later, an outer yoke forms the outer-radial magnetic-flux applying unit. However, the outer-radial magnetic-flux applying unit is not limited to these parts. Further, the term "free end" in the first embodiment refers to a side that is free (in other words, not in contact with another part). For instance, the side of the top plate that is opposite to the side adjacent to the annular magnets or the side of the yoke that is opposite to the bottom yoke.

The term "thermal bonding" refers to a condition where one part is connected to another part so as to facilitate thermal conduction. This also includes non-direct contact between parts such as via a layer of an adhesive agent. The term "encompass" refers to the state in which one part covers the surface of another part, where the two parts may or may not be in contact with each other. The term "sub-unit" not only refers to a sub-unit of a free end of a main unit but also includes a plurality of sub-units all having identical functions, where the sub-units may or may not be in contact with each other. The term "material with a good thermal conductivity" refers to any material whose thermal conductivity is better than at least air. The term "fastening member", refers to, apart from a bolt, may be a screw, a rivet, a nail, and the like.

In the speaker device according to a second embodiment of the present invention, openings are provided in the frame to facilitate air circulation between the space within the frame and the space outside the frame. The speaker device constructed thus has improved heat dissipation efficiency as the heat is not allowed to stagnate within the frame. The term "frame' refers to a part that completely encompasses the speaker device.

According to a third embodiment of the present invention, the heat-dissipating member described in the first embodiment is implemented in a so-called inner-magnet speaker device. In the speaker device according to the third embodiment, center magnets are provided to produce a magnetic flux. Also provided are a top plate that forms an inner-radial magnetic-flux applying unit, and an outer yoke that forms an outer-radial magnetic-flux applying unit. The center magnet, the top plate, and the outer yoke together form a magnetic circuit. A magnetic gap is formed between the facing outer surface of the top plate and the inner surface of the outer yoke.

In other words, in the speaker device according to the third embodiment, the magnetic circuit consists of cylindrical or disc-shaped center magnets, a cylindrical or disc-shaped top plate stacked atop the center magnets, and a cylindrical outer yoke with a bottom and disposed around the top plate, concentric with the top plate. The magnetic circuit forms a magnetic gap between the outer surface of the top plate and the inner surface of the outer yoke.

The heat-dissipating member is provided on the free end of the outer yoke. To increase the thermal bonding of the heat-dissipating member with the outer yoke, the outer yoke at its free end has a sub-outer yoke, which is smaller in diameter than the outer yoke, forming a step. The heat-dissipating member encompasses the step. In the speaker device constructed thus, heat from the voice coil is conducted to the free end of the outer yoke from where it can be effectively dissipated.

FIG. 1 is a vertical cross-section of a speaker device according to the first example of the present invention. As shown in FIG. 1, a speaker device 50 according to the present example includes a yoke 3 consisting of a center pole 1 and a bottom yoke 2, annular magnets 4 concentrically arranged around the center pole 1, and a top plate 5 that forms an outer-radial magnetic-flux applying unit, concentrically arranged around the center pole 1. The yoke 3, the annular magnets 4, and the top plate 5 form a magnetic circuit that creates a magnetic flux loop A (shown only on the left side in FIG. 1). The center pole 1 forms the inner-radial magnetic-flux applying unit and the top plate 5 forms the outer-radial magnetic-flux applying unit. The magnetic circuit forms a magnetic gap g between an outer surface 1*a* of the center pole 1 and an inner surface 5*c* of the top plate 5.

The speaker device 50 further includes a voice coil bobbin 6 set in the magnetic gap. A voice coil 7 is wound on the voice coil bobbin 6. The voice coil bobbin 6 is supported from a frame 9 by a spider 8, which is a damper, to vibrate in the axial direction of the center pole 1. A diaphragm 10 is connected to the voice coil bobbin 6. A heat-dissipating member 11 encompasses the free end of the top plate 5, that is the end opposite to the end adjacent to the annular magnets 4.

The yoke 3 is disposed in the central portion of the speaker device 50 and is composed of a magnetic substance, such as iron, etc. The yoke 3 consists of the center pole 1, which is shaped like a thick-walled cylinder, and the bottom yoke 2, which extends radially outward from the basal end of the center pole 1, that is the end of the center pole 1 opposite to the end connected to the diaphragm 10. The center pole 1 and the bottom yoke 2 form an integral unit. The bottom yoke 2 extends radially outward from the basal portion of the center pole 1 curving somewhat towards the diaphragm 10 in the shape of an umbrella. The portion of the bottom yoke 2 further radially outward from the umbrella-shaped extension is flat, forming a flat portion 2*a* having a plane that is orthogonal to the center pole 1. The flat portion 2*a* has a screw hole 2*b* passing therethrough in the axial direction of the center pole 1. A bolt 13 inserted through the screw hole 2*b* secures the yoke 3 to a base 9*b* of the frame 9.

Two annular magnets 4 are mounted on the flat portion 2*a* of the bottom yoke 2 such that the central axes of the annular magnets 4 are aligned with the central axis of the center pole 1. Each annular magnet 4 is a short cylindrical shaped magnet having a rectangular cross section. The two annular magnets 4 are adhesively bonded with each other and to the bottom yoke 2 by a not shown adhesive agent. The top plate 5 is stacked atop the face of the annular magnets 4 towards the diaphragm 10, with the central axis of the top plate 5 aligned with the central axis of the center pole 1. Instead of two annular magnets 4, a single annular magnet 4 may also be used.

The top plate is composed of a magnetic substance, such as iron, etc. The top plate 5 includes a second plate 5*b* and a first plate 5*a*, the second plate 5*b* being a main unit, and the first plate 5*a* being a sub-unit. The second plate 5*b* is disposed directly on top of the annular magnets 4 and is a flat ring of a larger diameter. The first plate 5*a* is disposed on the second plate 5*b* and is again a flat ring of a smaller diameter. The second plate 5*b* is adhesively bonded with the first plate 5*a* and to the annular magnets 4 by a not shown adhesive agent. The first plate 5*a* and the second plate 5*b* are positioned such that their inner peripheries are aligned to form the inner surface 5*c*. The inner diameter of the first plate 5*a* and the second plate 5*b* are smaller than the inner diameter of the annular magnets 4. In other words, the inner surface 5*c* of the top plate 5 juts towards the center pole 1 more than the inner surface of the annular magnets 4. The inner surface 5*c* of the top plate 5 is at a predetermined distance g from the outer surface 1*a* of the center pole 1.

The width of the second plate 5*b* of the top plate in the radial direction is substantially similar to the width of the annular magnets 4 in the radial direction. However, the width of the first plate 5*a* in the radial direction is approximately half of the width of the second plate 5*b* in the radial direction. Consequently, at the free end of the top plate 5 (upper end in FIG. 1), a step is formed because of the difference in the radial widths of the first plate 5*a* and the second plate 5*b*. Further towards the side of the diaphragm 10, a heat-dissipating member 11 is disposed on the top plate 5. The heat-dissipating member is composed of aluminum, which has a good thermal conductivity and is non-magnetic. It is important that the heat-dissipating member 11 be of a non-magnetic material that does not disturb the magnetic flux in the magnetic circuit.

Figure 2:
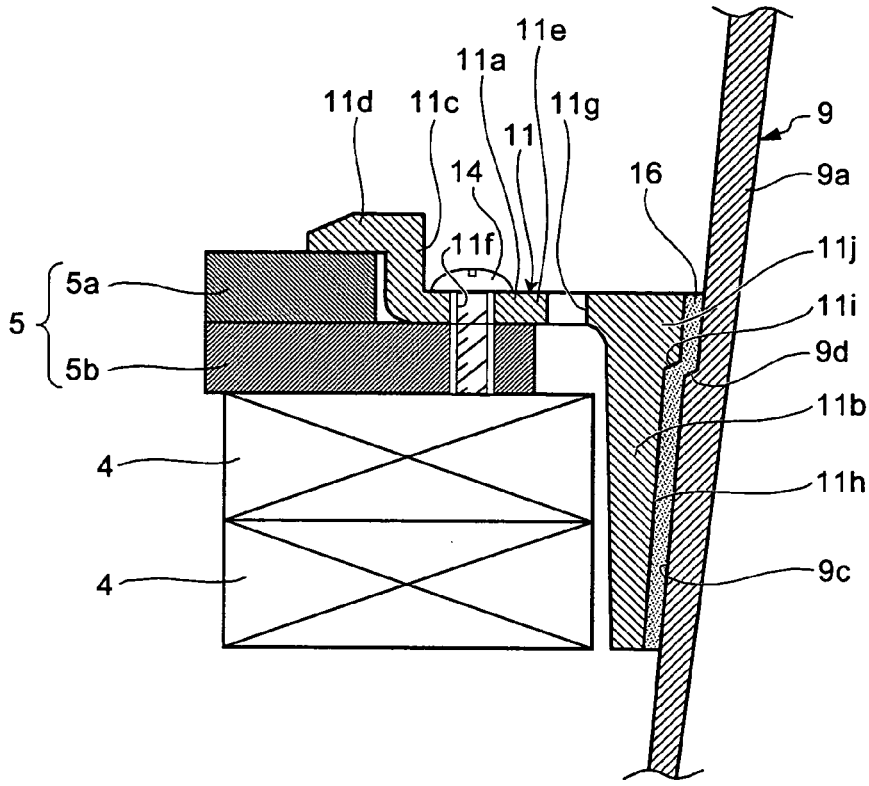
FIG. 2 is an enlarged view of the encircled area B in FIG. 1, representing a cross-section of a heat-dissipating member cut along the line II-II shown in FIG. 4.
Figure 3:
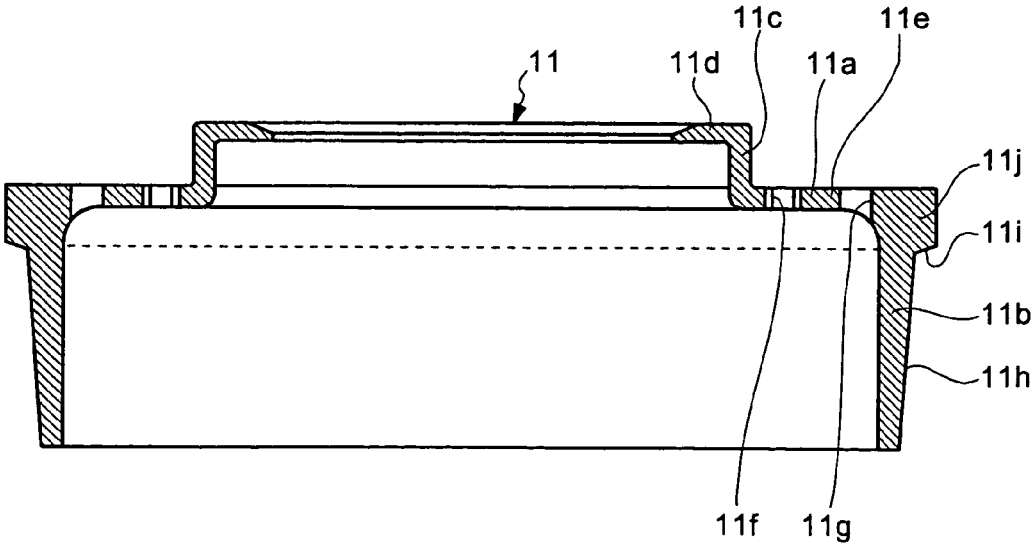
FIG. 3 is a vertical cross-section of the heat-dissipating member.
Figure 4:
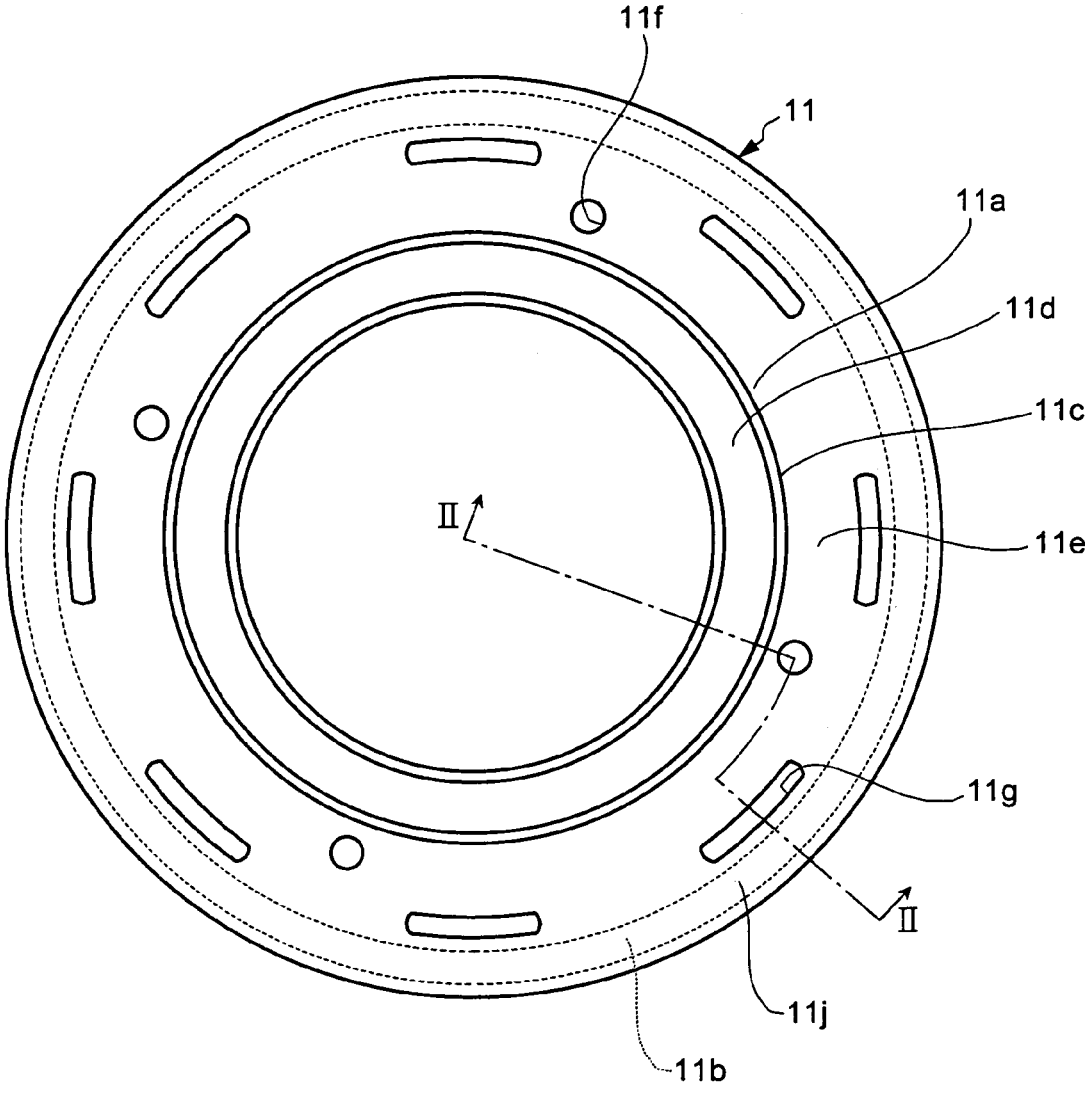
FIG. 4 is a drawing of the heat-dissipating member as viewed from the side of the diaphragm.
Figure 5:
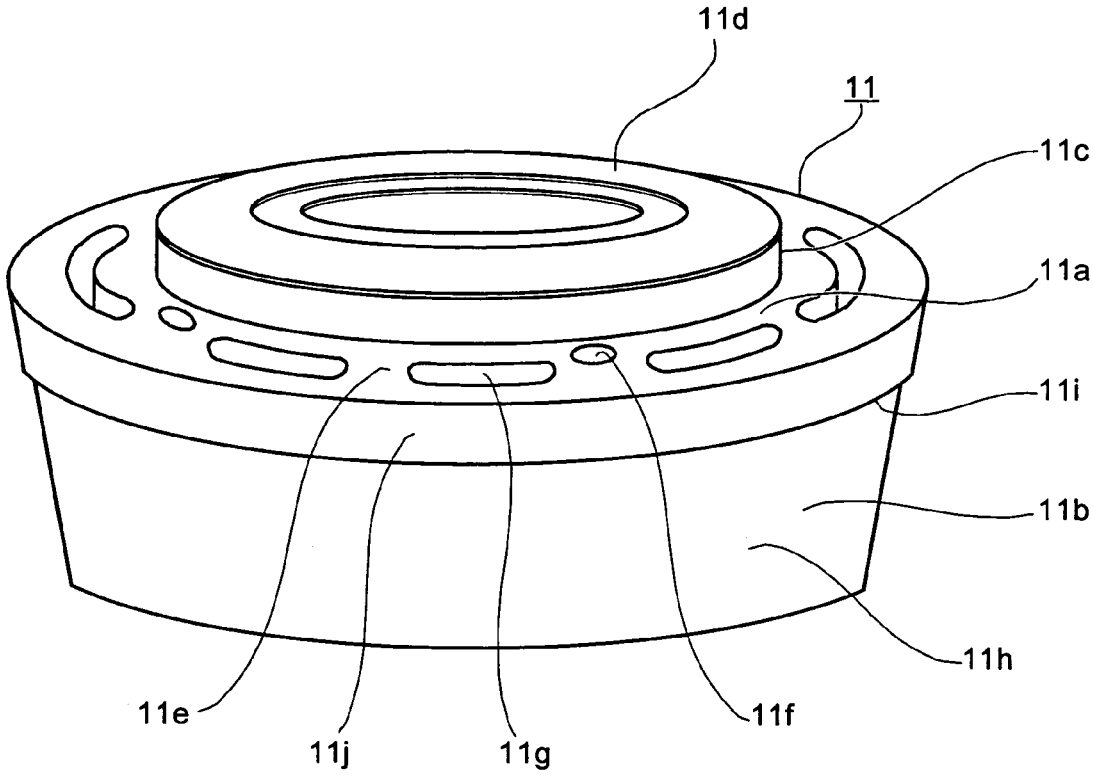
FIG. 5 is an oblique perspective view of the heat-dissipating member.

FIG. 2 is an enlarged view of the encircled area B in FIG. 1, representing a cross-section of the heat-dissipating member cut along the line II-II shown in FIG. 4. FIG. 3 is a vertical cross-section of the heat-dissipating member. FIG. 4 is a drawing of the heat-dissipating member as viewed from the side of the diaphragm. FIG. 5 is the oblique perspective view of the heat-dissipating member. In FIG. 2 through FIG. 5, the heat-dissipating member 11 includes a top plate-end contact portion 11*a* and a frame contact portion 11*b* forming an integral unit. The top plate-end contact portion 11*a* is an annular portion of the heat-dissipating member 11 that is in contact with the free end of the top plate 5 and has a crank-shaped outline. The frame contact portion 11*b* of the heat-dissipating member 11 is a cylindrical portion that extends from an outer peripheral portion 11*j* of the top plate-end contact portion 11*a* downward along the inner surface of the frame 9. A bent portion 11*c* runs all around the middle of the top plate-end contact portion 11*a* in the radial direction thereof. The height of the bent portion 11*c* in the axial direction is substantially-similar to or a little smaller than the height (thickness in the axial direction) of the second plate 5*b* so that the bent portion 11*c* can fit over the step formed on the top plate 5.

An inner radial portion 11*d* of the top plate-end contact portion 11*a* disposed to the inner radial side of the bent portion 11*c* is a flat surface facing and forming a contact surface with the principal surface of the first plate 5*a*. An outer radial portion 11*e* of the top plate-end contact portion 11*a* disposed to the outer radial side of the bent portion 11*c* is a flat surface facing and forming a contact surface with the principal surface of the second plate 5*b*.

Four through holes 11*f*, which serve as insertion holes for fastening members, are provided at equal distance around the circumference of the outer radial portion 11*e*. The through holes 11*f* are provided on the surface facing the second plate 5*b* and are oriented in the direction in which the first plate 5*a* and the second plate 5*b* are stacked. Screw holes are provided on the second plate 5*b* at the spots facing the through holes 11*f*. The heat-dissipating member 11 is secured to the second plate 5*b* by bolts 14 which serve as the fastening members inserted into the through holes 11*f*. In the portion between the outer radial portion 11*e* and the frame contact portion 11*b*, eight airflow orifices 11*g* are provided around the circumference. The airflow orifices 11*g* are elongated slots having a contour conforming to the curvature of the circumference of the surface on which they are provided. The airflow orifices 11*g* allow air to flow between the enclosed space formed by the top plate 5, the heat-dissipating member 11, the frame 9, and the bottom yoke 2 and the space on the side of the diaphragm 10.

The frame contact portion 11*b* and the frame 9 are adhesively bonded by an adhesive agent 16. It is preferable that the adhesive agent 16 has a good thermal conductivity. An outer surface 11*h* of the frame contact portion 11*b* that widens downward along the inner surface of the frame 9 from the outer peripheral portion 11*j* of the heat-dissipating member 11 is adhesively bonded with an inner surface 9*c* of the frame 9 by means of the adhesive agent 16, forming a large surface area of contact surface. A positioning step 11*i* formed on the rim of the outer surface 11*h* on the side of the diaphragm. 10 engages with a step 9*d* formed around the inner surface 9*c* of the frame 9, thus holding the heat-dissipating member 11 at a predetermined position with respect to the frame 9.

To return to FIG. 1, outer surface 1*a* of the center pole 1 and the inner surface 5*c* of the top plate 5 are separated in the radial direction by the magnetic gap g all around. The magnetic gap g extends along the axial direction of the center pole 1. In other words, the magnetic gap g is cylindrical. One end of a thin-walled long cylindrical voice coil bobbin 6 is set in the magnetic gap g. The voice coil 7 is wound around the outer surface of the portion of the cylindrical voice coil bobbin 6 facing the magnetic gap g. The voice coil bobbin 6 is supported from the frame 9 by the spider which functions as a damper, enabling the voice coil bobbin 6 to vibrate in the axial direction of the center pole 1 in the magnetic gap g. The frame 9 resembles a flower pot and includes a main frame 9*a* that widens like a horn and the base 9*b* at the narrow end of the main frame 9*a*, the main frame 9*a* and the base 9*b* forming an integral unit. Sunken through holes are provided at equal distance around the circumference of the base 9*b* for the bolts 13 to be inserted. The through holes are sunken so that the heads of the bolts 13 may not jut out of the bottom.

The functioning of the speaker device according to the present example is explained next. The annular magnets 4 through their own magnetic force generate the magnetic flux loop A in the magnetic circuit. The magnetic flux loop A forms a magnetic gap g between the outer surface 1*a* of the center pole 1 and the inner surface 5*c* of the top plate 5. When a voice signal current is supplied to the voice coil 7 set in the magnetic gap g, the voice coil 7 starts vibrating according to Fleming's left-hand rule. As a result, the diaphragm 10 connected to the vibrating voice coil 7 vibrates, producing sound.

The vibration of the voice coil 7 produces heat. The heat from the voice coil 7 is conducted to the top plate 5, which forms the outer-radial magnetic-flux applying unit, causing the top plate 5 to become hot. However, in the present example, the heat-dissipating member 11 absorbs the heat from the top plate 5. The heat absorbed by the heat-dissipating member 11 is dissipated into the air via the surface of the heat-dissipating member 11. In addition, the heat absorbed by the heat-dissipating member is conducted to the frame 9, and dissipated into the air via the surface of the frame 9. Consequently, the heating of the top plate 5 can be prevented. Meanwhile, the heat from the center pole 1, which forms the inner-radial magnetic-flux applying unit, is conducted to the frame 9 via the bottom yoke 2, and from the surface of the frame 9 dissipated into the air, similar to the conventional art described in case (1) under the section "Background Art". Consequently, the heating of the yoke 3, which includes the center pole 1, can also be prevented.

Thus, in the speaker device 50 according to the present example, the top plate 5 consists of the first plate 5*a* and the second plate 5*b* stacked one on top of the other in the axial direction of the center pole 1, with the first plate 5*a* is disposed on top of the second plate 5*b*. The heat-dissipating member 11 is thermally bonded with the top plate 5. Consequently, only as much heat as the volume of the heat-dissipating member 11 can stagnate. In addition, the heat-dissipating member 11 conducts the heat it absorbs very quickly, thus absorbing heat from the top plate 5 as the heat is produced and conducting the heat to another part or to the air from its own surface. Thus, the heat from the top plate 5 is effectively dissipated into the air via the heat-dissipating member 11, even if the top plate 5 consists of a plurality of plates. As a result, the heating of the top plate 5 and the resulting malfunctioning of the speaker device 50 can be prevented, thereby enhancing its durability.

The heat-dissipating member 11 is thermally bonded with the second plate 5*b* and thus absorbs the heat from the second plate 5*b*. Consequently, unlike in the conventional case, where heat from the plate (the second plate 5*b*) that is sandwiched between the annular magnets 4 and the first plate 5*a* is not easily dissipated, heat from the second plate 5*b* is adequately conducted to the heat-dissipating member 11, thus preventing heating of the second plate 5*b*. As a result, the rise in the temperature of the top plate 5 as a whole can be prevented. In the case where the top plate 5 is made of three or more plates, it is preferable to thermally bond the heat-dissipating member with all the plates disposed between the first plate 5*a* and the annular magnets 4. By having such a structure, the heat from each of the plates can be effectively absorbed even if the layer of adhesive agent between the plates impede heat conduction. Consequently, the temperature of the top plate can be lowered.

Further, the diameter of the first plate 5*a* is smaller than the diameter of the second plate 5*b*, thus forming a step at the free end of the top plate 5. The bent portion 11*c* of the heat-dissipating member 11 formed in the middle along the radial direction fits over the top plate 5. By having such a structure, a large contact surface area between the heat-dissipating member 11 and the top plate 5 can be realized, thereby increasing the thermal bonding. Consequently, more heat can be absorbed. Further, by designing the heat-dissipating member 11 to curve according to the contour of the top plate 5 to encompass its surface, more surface area can be encompassed with less material. Consequently, cost is cut down. Further, by having the bent portion 11*c* fit over the step, the bonding strength between the first plate 5*a* and the second plate 5*b* can be increased.

Furthermore, the outer radial portion 11*e* disposed outer radially with respect to the bent portion 11*c* of the heat-dissipating member 11 is secured to the second plate 5*b* by the bolts 14 traversing the outer radial portion 11*e* in the direction in which the first plate 5*a* and the second plate 5*b* are stacked. The bolts impart a fastening strength along the direction in which the first plate 5*a* and the second plate 5*b* are stacked. Consequently, the bolts 14 further ensure that the two surfaces remain in contact, thus ensuring a strong thermal bonding between the outer radial portion 11*e* of the heat-dissipating member 11 and the second plate 5*b*. Further, the fastening strength also gets transmitted to the inner radial portion 11*d* via the bent portion 11*c*, ensuring a strong thermal bonding between the inner radial portion 11*d* and the first plate 5*a*. The fastening strength also acts on the first plate 5*a*, tightly sandwiching it between the inner radial portion 11*d* and the second plate 5*b*, thus making the mounting strength between the first plate 5*a* and the second plate 5*b* a strong one. The fastening strength can be adjusted by loosening or tightening the bolts 14. Thus, for instance, deformities in the top plate 5 can also be corrected by loosening or tightening one or several of the four bolts 14 or by tightening all the bolts to increase thermal bonding between the top plate 5 and the heat-dissipating member 11.

The airflow orifices 11*g* provided in the heat-dissipating member 11 facilitate air circulation between the space within the heat-dissipating member 11 and the space outside the heat-dissipating member 11. In the speaker device 50 according to the present example, the heat-dissipating member 11 extends up to the frame 9. Therefore the space within the heat-dissipating member 11 is a somewhat closed space, enclosed by the heat-dissipating member 11, the annular magnets 4, and the top plate 5. However, the airflow orifices 11*g* facilitate air circulation between the space within the heat-dissipating member 11 and the space outside the heat-dissipating member 11. Consequently, the heated air in the space within the heat-dissipating member 11 is expelled to the space outside the heat-dissipating member 11, effectively dissipating the heat.

The outer peripheral portion 11*j* of the heat-dissipating member 11 is secured to the frame 9 and is thermally bonded with it. Thus, the heat-dissipating member 11 conducts the heat absorbed from the top plate 5 to the frame 9, from where the heat is dissipated, thereby achieving improved heat dissipation efficiency.

Furthermore, the frame contact portion 11*b* of the heat-dissipating member 11 that extending from the outer peripheral portion 11*j* of the heat-dissipating member 11 along the inner surface of the frame 9 provides an adequate contact surface area for conducting heat from the heat-dissipating member 11 to the frame 9. The frame contact portion 11*b* does not allow the heat to stagnate in the heat-dissipating member 11, thus increasing the heat dissipation efficiency of the heat-dissipating member 11. The frame contact portion 11*b* may be designed to extend upward (that is, towards the diaphragm 10).

Further, the step 9*d* is provided on the inner surface of the frame 9, which engages with the outer peripheral portion 11*j* of the heat-dissipating member 11. As a result, the heat-dissipating member 11 is held in a predetermined position with respect to the frame 9. This arrangement allows easy assembling of the speaker device 50. The positioning accuracy produces a highly efficient speaker device, increases the mounting strength, and enhances durability.

The bottom yoke 2 extends radially outward from the basal portion of the center pole 1 and is thermally bonded with the base 9*b* of the frame 9 by means of bolts 13 that secure the bottom yoke to the base 9*b*. Because of the adequate thermal bonding between the bottom yoke 2 and the frame 9, the heat generated in the voice coil 7 and the top plate 5 is conducted to the frame 9 via the center pole 1, further enhancing the heat dissipation efficiency. Thus, the two systems of heat conduction routes, namely via the heat-dissipating member 11 and via the center pole 1, together increase the heat dissipation. Since, in both the systems, the heat is dissipated to the exterior from the frame 9, the frame may be provided with corrugated fins if seeking to improve the heat dissipation efficiency by increasing the heat dissipation surface area. Consequently, heat dissipation by both the systems can be increased and cost-to-performance ratio improved.

Further, the heat-dissipating member 11 according to the present example is thermally bonded with the top plate 5 of the speaker device 50 and dissipates the heat by conducting the heat of the top plate 5 to another part. The bent portion 11*c* having a crank-shaped cross section and running around the middle of the top plate-end contact portion 11*a* in the radial direction thereof fits over the step formed by the first plate 5*a* and the second plate 5*b*. Consequently, the heat-dissipating member 11 is able to thermally bond with both the first plate 5*a* and the second plate 5*b* and conducts the heat from both the first plate 5*a* and the second plate 5*b* to another part, thus dissipating the heat. By fitting over the step, the bent portion 11*c* clamps together the first plate 5*a* and the second plate 5*b*, thus making the mounting strength between the first plate 5*a* and the second plate 5*b* a strong one and improving the bonding strength.

The heat-dissipating member 11 according to the present example is composed of aluminum. However, the heat-dissipating member 11 may be composed of any material that is non-magnetic and has a good thermal conductivity such as aluminum alloy, copper, etc. The surface of the heat-dissipating member 11 may be contoured or provided with corrugated fins to increase the surface area and thus improve the heat dissipation efficiency. In the heat-dissipating member 11 according to the present example, a single bent portion 11*c* is provided fitting over the a single step formed by the first plate 5*a* and the second plate 5*b* of the top plate 5. However, if the top plate 5 consists of three plates, two bent portions 11*c* may be provided, fitting over the two steps formed by the three plates of the top plate 5.

The heat-dissipating member 11 according to the present example is secured to the second plate 5*b* by the bolts 14 inserted into the through holes 11*f*. However, the fastening device need not be limited to bolts. An adhesive agent may be used to secure the heat-dissipating member 11 to the second plate 5*b*. Or, an adhesive agent may be used to secure the heat-dissipating member 11 to both the first plate 5*a* and the second plate 5*b*. Alternatively, a combination of bolts and adhesive agent may be employed. Again, neither bolts nor adhesive agent may be used and the heat-dissipating member 11 may be just fitted over the top plate 5. Further, the step 9*d* is provided all around the inner surface of the frame. The step 9*d* may be provided intermittently. Further, there are two annular magnets 4 provided in the speaker device 50 according to the present example. The number of annular magnets 4 may be one or three or greater.

Figure 6:
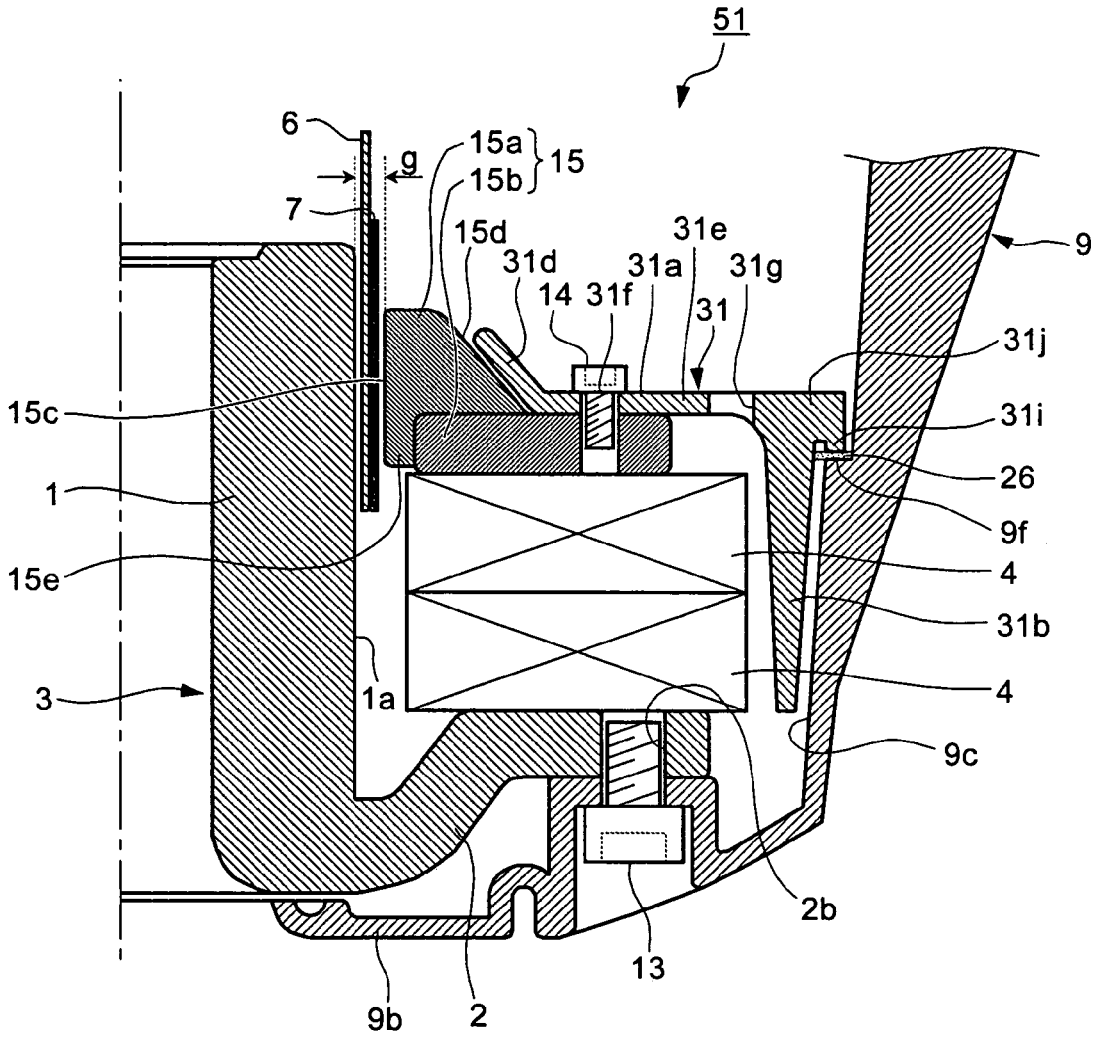
FIG. 6 is a vertical cross-section of a speaker device according to a second example of the present invention.

FIG. 6 is a vertical cross-section of the speaker device according to a second example of the present invention. A speaker device 51 according to the second example of the present invention includes a top plate 15 consisting of a first plate 15*a* and a second plate 15*b*. The second plate 15*b*, which is a main unit of the top plate 15, is directly stacked atop the annular magnets 4 and is flat and annular having a larger diameter. The first plate 15*a*, which is a sub-unit of the top plate 15, is stacked atop the second plate 15*b*. The first plate 15*a* has trapezoidal cross section, and is annular with a smaller diameter. The first plate 15*a* and the second plate 15*b* are adhesively bonded with each other by a not shown adhesive agent. Similarly, the second plate 15*b* is adhesively bonded with the annular magnets 4 by the adhesive agent.

The height (thickness in axial direction) of the first plate 15*a* having a trapezoidal cross section is approximately twice the thickness of the second plate 15*b* in the axial direction. The first plate 15*a* includes a magnetic gap facing portion 15*e* that extends in the axial direction on the magnetic gap g side of the first plate 15*a*. The magnetic gap facing portion 15*e* extends in the direction of the bottom yoke 2 all around, substantially encompassing the entire inner surface of the second plate 15*b*.

Only an inner surface 15*c* of the first plate 15*a* faces the magnetic gap g. The outer surface of the first plate 15*a* has a sloping surface 15*d*. There are two reasons for providing a sloping outer surface. The first reason relates to the fact that reducing the contact surface area between the first plate 15*a* and the second plate 15*b* gives rise to magnetic saturation. Consequently, a predetermined contact surface area between the first plate 15*a* and the second plate 15*b* is mandatory. The second reason is to reduce the material required for making the first plate 15*a*. In other words, the first plate 15*a* extends in the axial direction forming the magnetic gap facing portion 15*e* such that, inner radially, the first plate 15*a* has only the inner surface 15*c* facing the magnetic gap g. Further, providing the necessary contact surface area between the first plate 15*a* and the second plate 15*b* and reducing the material required to make the first plate 15*a* renders the first plate 15*a* with a trapezoidal cross section.

A heat-dissipating member 31 according to the present example includes a top plate-end contact portion 31*a* and a frame contact portion 31*b* forming an integral unit. The top plate-end contact portion 31*a* is an annular portion of the heat-dissipating member 31 that is in contact with the free end of the top plate 15, with a bent portion running all around at the place the sloping surface 15*d* ends on the second plate 15*b* side. The frame contact portion 31*b* of the heat-dissipating member 31 is a cylindrical portion that extends from an outer peripheral portion 31*j* of the top plate-end contact portion 31*a* downward along the inner surface of the frame 9.

The flat surface of an inner radial portion 31*d* of the top plate-end contact portion 31*a* disposed to the inner radial side of the bent portion of the top plate-end contact portion 31*a* and facing the first plate 15*a* is parallel to the sloping surface 15*d* of the first plate 15*a*. The flat surface of an outer radial portion 31*e* of the top plate-end contact portion 31*a* disposed to the outer radial side of the bent portion and facing the second plate 15*b* forms a contact surface with the principal surface of the second plate 15*b*.

Four through holes 31*f*, which serve as insertion holes for fastening members, are provided at equal distance around the circumference of the outer radial portion 31*e*. The through holes 31*f* are provided on the surface facing the second plate 15*b* and are oriented in the direction in which the first plate 15*a* and the second plate 15*b* are stacked. Screw holes are provided on the second plate 15*b* at the spots facing the through holes 31*f*. The heat-dissipating member 31 is secured to the second plate 15*b* by the bolts 14 which serve as the fastening members inserted into the through holes 11*f*. In the portion between the outer radial portion 31*e* and the frame contact portion 31*b*, eight airflow orifices 31*g* are provided around the circumference. The airflow orifices 31*g* are elongated slots having a contour conforming to the curvature of the circumference of the surface on which they are provided. The airflow orifices 31*g* allow air to circulate between the enclosed space formed by the top plate 15, the heat-dissipating member 31, the frame 9, and the bottom yoke 2 and the space on the side of the diaphragm 10.

A positioning step 31*i* formed on the outer peripheral portion 31*j* on the side of the base 9*b* of the frame 9 engages with a horizontal step 9*f* formed at a position facing the positioning step 31*i* around the inner surface 9*c*, thus holding the heat-dissipating member 31 at a predetermined position with respect to the frame 9. The heat-dissipating member 31 is secured to the frame 9 by an adhesive agent applied on the facing surfaces of the positioning step 31*i* and the horizontal step 9*f*. The rest of the structure is similar to that of the speaker device according to the first example.

Thus, in the speaker device according to the present example, the magnetic gap facing portion 15*e* of the first plate 15*a* extends on the side of the magnetic gap g, encompassing the inner surface of the second plate 15*b* so that only the inner surface 15*c* of the first plate 15*a* faces the magnetic gap g. By providing the inner surface 15*c* of the top plate 15 on one part, namely, the first plate 15*a*, a smoother surface can be obtained more reliably and easily compared to the case described in the first example where the inner surface 5*c* is formed jointly by the inner surfaces of the first plate 5*a* and the second plate 5*b*. Further, the smooth surface devoid of any joints increases the efficiency of the magnetic gap g.

Further, the surface of the magnetic gap facing portion 15*e* of the first plate 15*a* opposite to the surface facing the magnetic gap g is tightly bonded with the inner surface of the second plate 15*b*, enhancing the integrity of the first plate 15*a* and the second plate 15*b*. The bond the surface of the magnetic gap facing portion 15*e* of the first plate 15*a* opposite to the surface facing the magnetic gap g tightly with the second plate 15*b*, a small clearance which serves as a run-off is provided between the sloping surface 15*d* of the first plate 15*a* and the inner radial portion 31*d* of the heat-dissipating member 31. The clearance should be a small one taking into consideration the heat dissipation. The clearance is always filled with the adhesive agent used for adhesively bonding the top plate 15 with the annular magnets 4.

Figure 7:
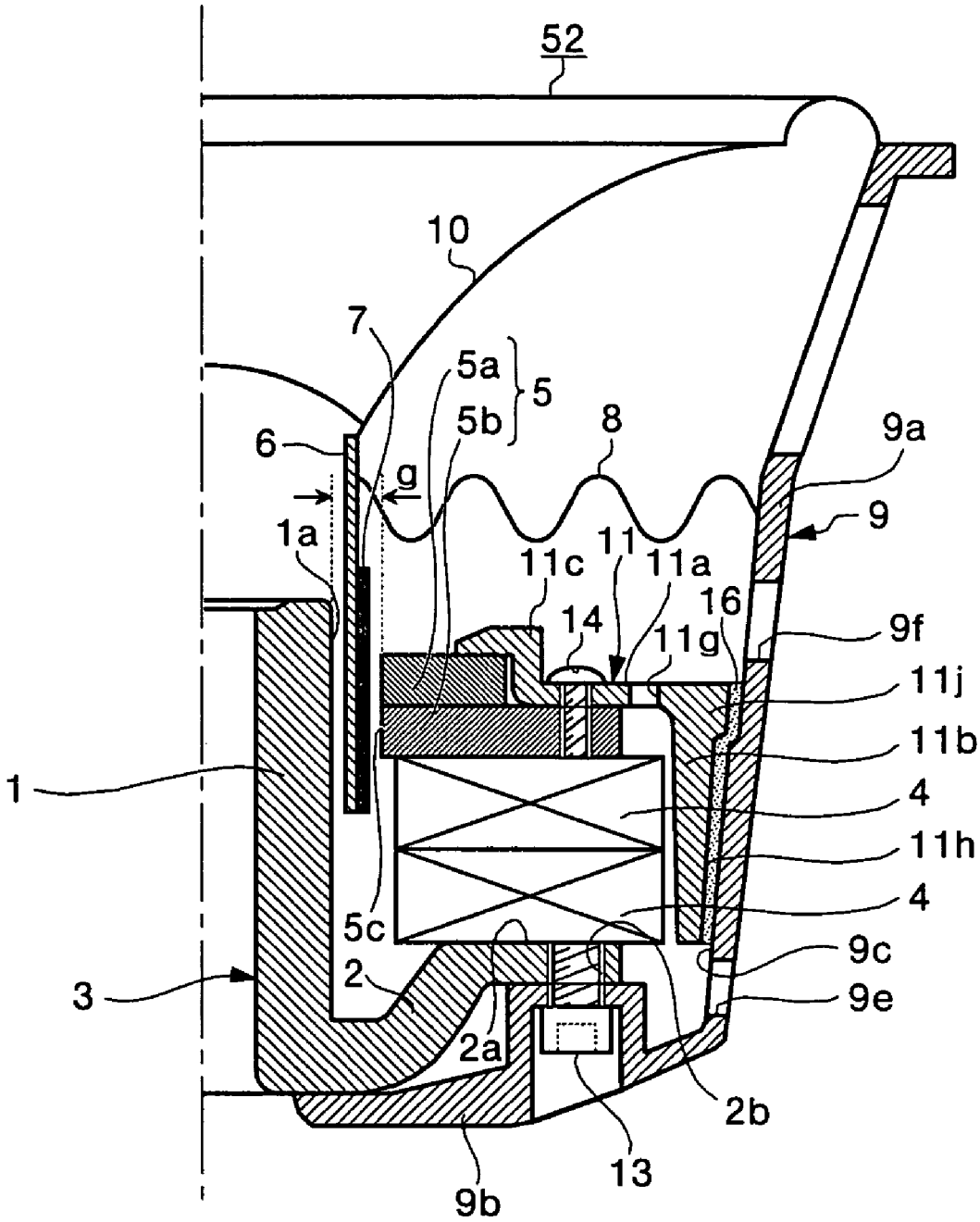
FIG. 7 is a vertical cross-section of a speaker device according to a third example of the present invention.

FIG. 7 is a vertical cross-section of the speaker device according to a third example. In a speaker device 52 according to the third example, openings 9*e* and 9*f* are provided in the main frame 9*a*. The opening 9*f* is provided between the heat-dissipating member 11 and the spider 8 on the side of the diaphragm 10 above the portion where the heat-dissipating member 11 is in contact with the main frame 9*a*. The opening 9*e* is provided near the base 9*b* below the portion where the heat-dissipating member 11 is in contact with the main frame 9*a*. The rest of the structure is similar to that of the speaker device according to the first example.

The openings 9*e* and 9*f*, together with the airflow orifices 11*g* facilitate air circulation between the space within the frame 9 and the space outside the frame 9. The speaker device 52 constructed thus has a further improved heat dissipation efficiency as the heat is not allowed to stagnate within the frame 9. The openings 9*e* and 9*f* may also be provided in the base 9*b* of the frame 9 instead of in the main frame 9*a*.

The first to the third examples are described with reference to the outer-magnet speaker device. A fourth example is described with reference to an inner-magnet speaker device in which the heat-dissipating member is implemented.

Figure 8:
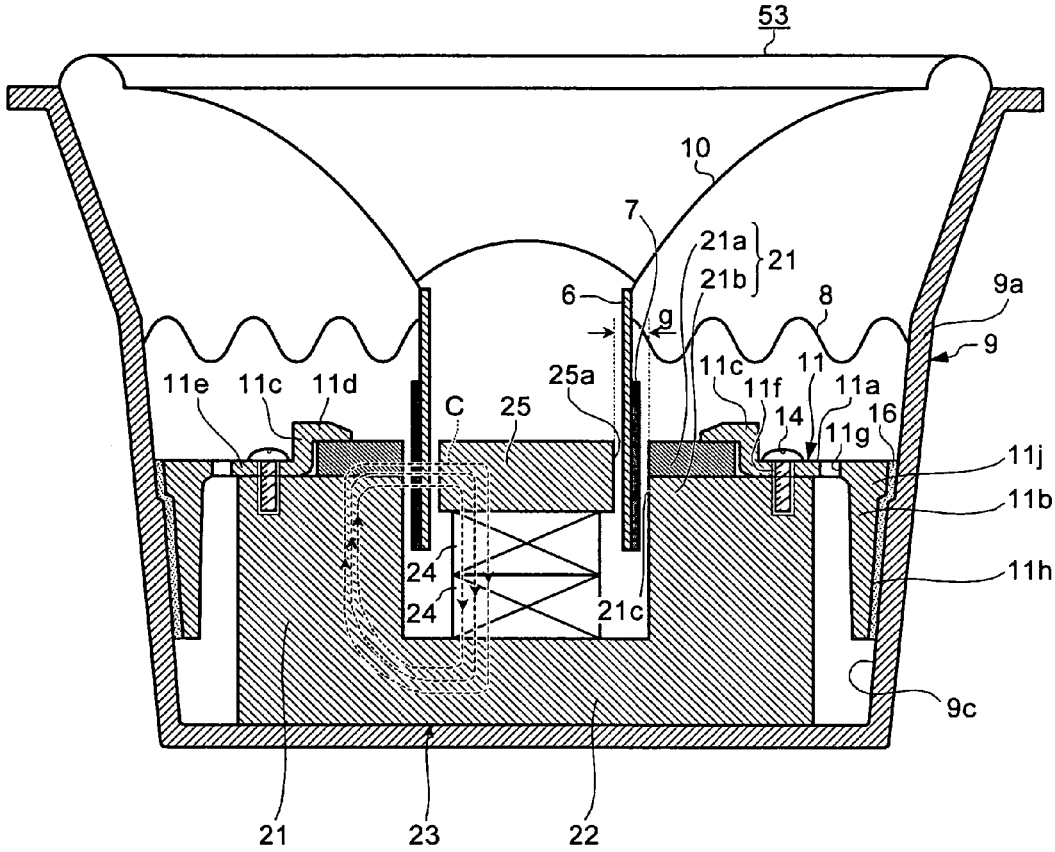
FIG. 8 is a vertical cross-section of a speaker device according to a fourth example of the present invention.

FIG. 8 is a vertical cross-section of the speaker device according to the fourth example. As shown in FIG. 8, a speaker device 53 includes a magnetic circuit that creates a magnetic flux loop C (shown only on the left side in FIG. 8). The magnetic circuit consists of two center magnets 24 placed in the mid portion of the speaker device 53, a top plate 25 stacked atop the center magnets 24, and a yoke 23 which encloses the center magnets 24 and the top plate 25. The yoke 23 consists of a cylindrical outer yoke 21 and a bottom yoke 22 that forms the base. The top plate 25 of the magnetic circuit forms an inner-radial magnetic-flux applying unit, and the outer yoke 21 forms the outer-radial magnetic-flux applying unit. The magnetic gap g is formed between an outer surface 25*a* of the top plate 25 and an inner surface 21*c* of the outer yoke 21.

The center magnets 24 are short cylindrical or disc-shaped magnets. Two center magnets 24 are staked in the mid portion of the speaker device 53. On the side of the diaphragm 10, the top plate 25 is adhesively bonded with the center magnets 24 by an adhesive agent. The top plate 25 is a short cylindrical or circular disc-shaped part composed of iron, etc. The center magnets 24 and the top plate 25 are enclosed by the cylindrical yoke 23, which is a cylindrical shaped part with a bottom.

The yoke 23 consists of the outer yoke 21 having the shape of a thick-walled cylinder, and the bottom yoke 22, which forms a base on the side opposite to the side of the diaphragm 10. The central axis outer yoke 21 is aligned with the central axis of the top plate 25. The outer yoke 21 and the bottom yoke 22 form an integral unit. The outer yoke 21 further consists of a main outer yoke 21*b* having a thick-walled cylindrical shape, and a flat ring-shaped sub-outer yoke 21*a* stacked atop a free end of the main outer yoke 21*b*, that is, the end opposite the bottom yoke 22.

The main outer yoke 21*b* and the sub-outer yoke 21*a* are adhesively bonded with each other by a not shown adhesive agent. The inner surfaces of the main outer yoke 21*b* and the sub-outer yoke 21*a* are aligned to form a single cylindrical inner surface 21*c* that faces the magnetic gap g.

The width of the sub-outer yoke 21*a* is approximately half the width of the main outer yoke 21*b*. Consequently, a step is formed at the free end of the outer yoke 21 because of the difference in the radial widths of the sub-outer yoke 21*a* and the main outer yoke 21*b*. The free end of the outer yoke 21 on the side of the diaphragm 10 is encompassed by the heat-dissipating member 11 similar to the one according to the first example. The inner radial portion 11*d* of the heat-dissipating member 11 forms a contact surface with the sub-outer yoke 21*a*. The outer radial portion 11*e* of the heat-dissipating member 11 forms a contact surface with the main outer yoke 21*b*.

In the speaker device 53 constructed thus, the heat-dissipating member 11 is mounted in a similar manner to that in the speaker device according to the first example by providing a step formed by the difference in the radial widths of the main outer yoke 21*b* and the sub-outer yoke 21*a*. The heat-dissipating member 11 according to the present example functions in a manner similar to the heat-dissipating member 11 with respect to the top plate 5 in the first example. That is, the heat-dissipating member 11 in the present example effectively dissipates the heat of the outer yoke 21. Conduction of the heat to the frame 9 is similar to that in the first example. The bolts 14 in the present example produce the same effect of enhancing the bonding strength.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. A speaker device comprising:

a magnet that generates magnetic flux;

an inner-radial magnetic-flux applying unit including an outer circumferential surface;

an outer-radial magnetic-flux applying unit including an inner circumferential surface, a main unit having a first diameter, and at least one piece of annular sub-unit having a second diameter stacked on an end of the main unit on a side of an opening of the main unit;

a voice coil that is supported in a vibrating manner in a magnetic gap that is formed between the outer circumferential surface and the inner circumferential surface by a magnetic circuit formed with the magnet, the inner-radial magnetic-flux applying unit, and the outer-radial magnetic-flux applying unit, to which the magnetic flux is applied via the inner-radial magnetic-flux applying unit and the outer-radial magnetic-flux applying unit;

a heat-dissipating member that is made of a material with a good thermal conductivity, encompasses an end portion of the outer-radial magnetic-flux applying unit including the sub-unit, and is thermally bonded with the outer-radial magnetic-flux applying unit; and a frame that encloses the magnetic circuit, wherein an outer peripheral portion of the heat-dissipating member is thermally bonded with the frame, and wherein the outer peripheral portion includes a frame contact portion that widens along an inner surface of the frame in a manner so as to skirt cover the magnet in a nested-structure manner with the frame, while thermally bonding with the frame.

2. The speaker device according to claim 1, wherein the heat-dissipating member is thermally bonded at least with the main unit, and absorbs heat from the main unit.

3. The speaker device according to claim 2, wherein the second diameter is smaller than the first diameter such that an outer rim of the sub-unit forms a step on the end portion of the outer-radial magnetic-flux applying unit, the heat-dissipating member has a bent portion running all around in a middle in a radial direction, and the bent portion is engaged with the step.

4. The speaker device according to claim 3, wherein the heat-dissipating member includes an inner radial portion that is disposed on an inner side of the bent portion, and makes a surface contact with the sub-unit;

an outer radial portion that is disposed on an outer side of the bent portion, and makes a surface contact with the main unit, and the outer radial portion is fastened to the main unit by a fastening member intersectingly penetrating a surface of a contact.

5. The speaker device according to claim 1, wherein the heat-dissipating member includes an airflow orifice for air circulation between a space within the heat-dissipating member and a space outside the heat-dissipating member.

6. The speaker device according to claim 1, wherein an inner surface of the frame includes a step for engaging with the outer peripheral portion of the heat-dissipating member.

7. The speaker device according to claim 1, wherein the frame includes an opening for air circulation between a space within the frame and a space outside the frame.

8. The speaker device according to claim 1, wherein the magnetic circuit includes the inner-radial magnetic-flux applying unit that is cylindrical, the magnet that is annular and concentrically arranged around the inner-radial magnetic-flux applying unit, and the outer-radial magnetic-flux applying unit that is annular and stacked on the magnet and concentrically arranged around the inner-radial magnetic-flux applying unit, and forms the magnetic gap between the outer circumferential surface and the inner circumferential surface.

9. The speaker device according to claim 8, wherein the outer-radial magnetic-flux applying unit includes a plurality of plates stacked in an axial direction of the inner-radial magnetic-flux applying unit, the sub-unit is a first plate disposed on the end portion of the outer-radial magnetic-flux applying unit, the main unit is a second plate sandwiched between the first plate and the magnet, and the heat-dissipating member thermally bonds at least with the second plate and absorbs heat from the second plate.

10. The speaker device according to claim 9, wherein the first plate has a smaller diameter than the second plate, forming a step on a surface of the outer-radial magnetic-flux applying unit opposite to a surface facing the magnet, the heat-dissipating member has a bent portion running all around in a middle in a radial direction, and the bent portion is engaged with the step.

11. The speaker device according to claim 9, wherein the first plate includes a magnetic gap facing portion that extends on a side facing the magnetic gap and encompasses an inner surface of the second plate, and the inner circumferential surface of the outer-radial magnetic-flux applying unit facing the magnetic gap is formed solely by an inner surface of the first plate.

12. The speaker device according to claim 8, wherein the frame encloses the magnet, the inner-radial magnetic-flux applying unit, and the outer-radial magnetic-flux applying unit, and wherein a radial extension portion that is formed by extending radially from a base integrally with the inner-radial magnetic-flux applying unit is thermally bonded with the frame.

13. The speaker device according to claim 1, wherein the magnetic circuit includes the magnet that is cylindrical or disc-shaped, the inner-radial magnetic-flux applying unit that is cylindrical or disc-shaped and stacked on the magnet, and the outer-radial magnetic-flux applying unit having a shape of a cylinder with a bottom and arranged concentrically around the inner-radial magnetic-flux applying unit, and forms the magnetic gap between the outer circumferential surface and the inner circumferential surface.

14. A heat-dissipating member for a speaker device that includes at least a magnet and a frame which supports the magnet, the heat-dissipating member being made of a material with a good thermal conductivity and thermally bonded with an outer-radial magnetic-flux applying unit that applies magnetic flux on a voice coil that is supported in a vibratable manner in a magnetic gap, the heat-dissipating member comprising:

an annular end-face contact portion that encompasses an edge of an end portion of the outer-radial magnetic-flux applying unit on a side of an opening of the outer-radial magnetic-flux applying unit; and a bent portion running all around in a middle in a radial direction, wherein the bent portion is engaged with a step formed on the end portion of the outer-radial magnetic-flux applying unit, wherein an outer peripheral portion of the annular end-face contact portion is thermally bonded with the frame, and wherein the outer peripheral portion includes a frame contact portion that widens along an inner surface of the frame so as to skirt cover the magnet in a nested-structure manner with the frame, while thermally bonding with the frame.

15. The heat-dissipating member according to claim 14, wherein the outer-radial magnetic-flux applying unit includes a main unit and at least one piece of annular sub-unit stacked on an end of the main unit on a side of an opening of the main unit, the end-face contact portion includes an inner radial portion that is disposed on an inner side of the bent portion, and makes a surface contact with the sub-unit;

an outer radial portion that is disposed on an outer side of the bent portion, and makes a surface contact with the main unit, and an insertion hole for fastening the outer radial portion that intersectingly penetrates a surface of a contact that is formed in the outer radial portion.

16. The heat-dissipating member according to claim 15, further comprising an airflow orifice between the outer radial portion and the outer peripheral portion for air circulation.

* * * * *